United States Patent [19]

Abeille et al.

[11] 4,220,004

[45] Sep. 2, 1980

[54] HYDRAULIC SERVO-CONTROL SYSTEM WITH OUT-OF-BALANCE LOAD

[75] Inventors: Jean Abeille; Jacques Coeuillet; Francois Coutenceau; Claude Grandfils, all of Paris, France

[73] Assignee: Thomson-CSF, Paris, France

[21] Appl. No.: 41,412

[22] Filed: May 22, 1979

[30] Foreign Application Priority Data

May 26, 1978 [FR] France ..... 78 15795

[51] Int. Cl.[3] ..... F15B 1/02; F15B 21/08

[52] U.S. Cl. ..... 60/413; 60/484; 60/DIG. 2; 91/171; 91/511

[58] Field of Search ..... 60/413, 420, 484, DIG. 2; 91/170, 171, 508, 511

[56] References Cited

U.S. PATENT DOCUMENTS

| | | | |
|---|---|---|---|
| 2,782,603 | 2/1957 | Beecroft | 91/171 |
| 2,969,647 | 1/1961 | Raymond | 91/171 |
| 3,262,740 | 7/1966 | Stockwell | 91/171 |

*Primary Examiner*—Edgar W. Geoghegan
*Attorney, Agent, or Firm*—Karl F. Ross

[57] ABSTRACT

There is described a servo-control system incorporating a double-acting ram which is responsible for compensating electro-hydraulically for the imbalance in a servo-controlled load in order to achieve a high performance. To this end, a compensating loop is produced which slaves a balancing pressure $P_e$ to the variations in the imbalance. This pressure is exerted in one of the chambers of the ram, separately from the control pressure. It is governed by a pneumatic accumulator whose load is a function of the lack of balance between the pressure exerted by the imbalance and the balancing pressure.

11 Claims, 5 Drawing Figures

Prior Art Fig. 1
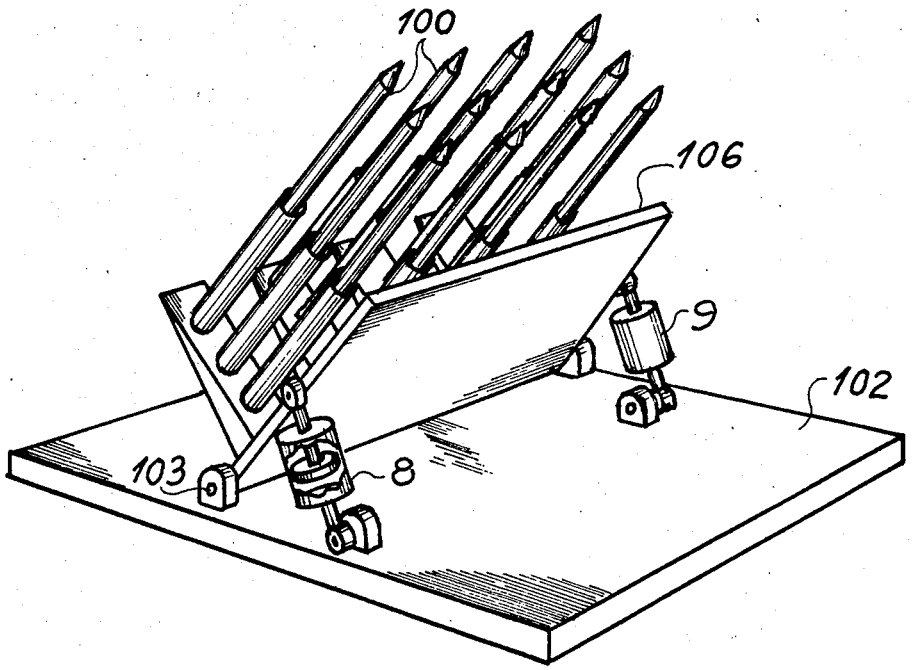
Prior Art Fig. 2
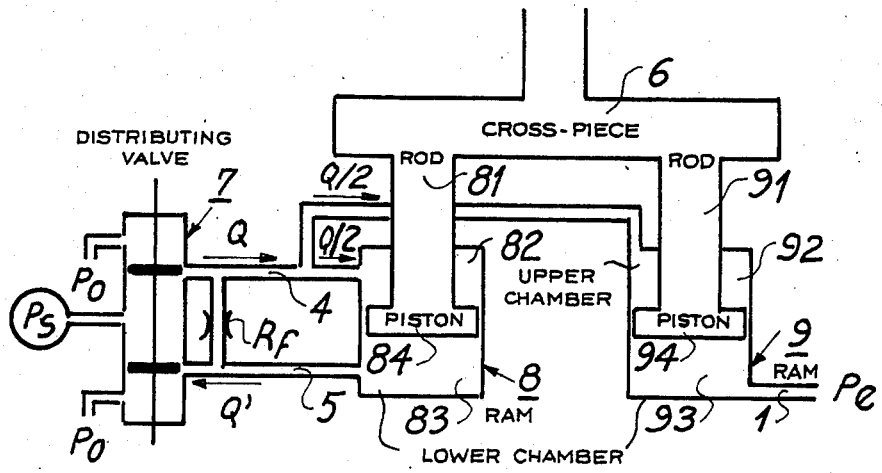

Fig_4
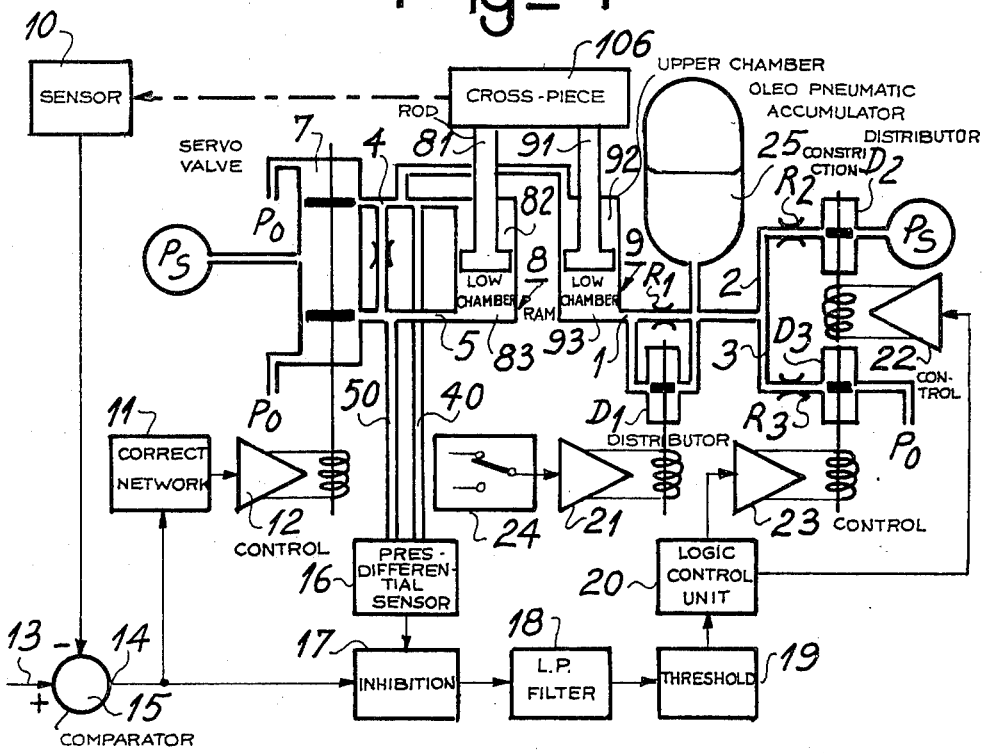
Prior Art Fig_3
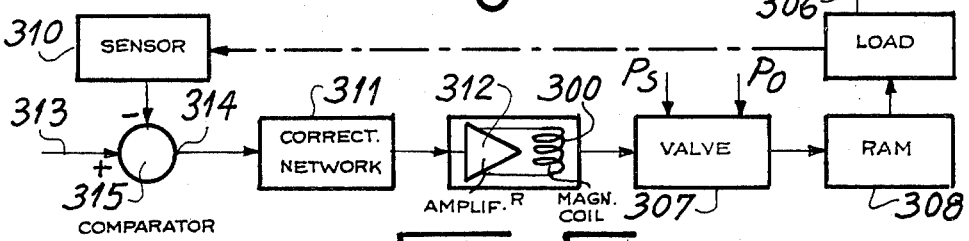
Fig_5
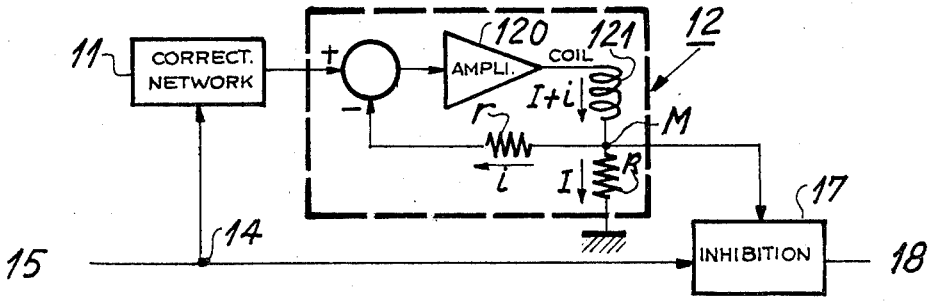

HYDRAULIC SERVO-CONTROL SYSTEM WITH OUT-OF-BALANCE LOAD

BACKGROUND OF THE INVENTION

The present invention relates to a hydraulic servo-control system whose load is out of balance by a varying amount, this servo-control system comprising in particular a double-acting, single-rod ram or jack or preferably two half double acting single-rod rams or jacks.

A particular field of application for the present invention is in servo-controlling the elevation of a missile launching ramp.

A load which is unbalanced is a load whose effect is asymmetrical in operation. A missile-launching ramp, for example, exerts a considerable weight on the means for controlling it in elevation and this weight means that more power is required to raise the ramp than to lower it.

It is known that to control loads which are unbalanced to any major degree, servo-control systems employing hydraulic rams are preferable to systems employing electric motors, since the latter would necessitate the use of motors of disproportionate power. This is the case with missile-launching ramps where rams are automatically used above a certain weight.

As prior art, FIG. 1 shows such a ramp and the means for servo-controlling it in elevation. The missiles 100 are arranged on an inclined surface 106 (which will be termed hereinafter the mechanical elevating structure) which is movable in relation to a horizontal base 102 about an axis 103. Two rams 8 and 9 determine the position of the ramp in elevation.

It is known, on the one hand, that the double-acting rams mentioned above are such that they can be operated by applying a control pressure which acts on either side of the piston, in contrast to single-acting rams where the control pressure acts on only one side of the piston.

On the other hand, single-rod rams, in which a single rod is attached to one of the faces of the driving piston, are contrasted with double-rod rams in which the piston carries two rods each fixed to one of its faces.

A double-acting, single-rod ram is shown diagrammatically in FIG. 2. This Figure illustrates a specific arrangement described in French Pat. No. 2,063,698, which combines two conventional single-rod rams 8 and 9 to produce a symmetrical double-acting combination. The two rams 8 and 9 are identical and are secured rigidly together by their rods 81 and 91 and a common cross-piece 6. The pistons 84 and 94 separate the corresponding rams into two chambers, which are 82 and 92 respectively in the case of the upper chambers and 83 and 93 respectively in the case of the lower chambers.

The system is supplied with fluid, such as oil for example, through a 4-way valve or distributing slide-valve 7 which has connections to a working pressure $P_s$ and a reference pressure $P_o$, which may be atmospheric pressure for example. A hydraulic circuit 5 connects the distributing slide-valve 7 to the lower chamber 83. A hydraulic circuit 4 provides identical supplies for the two upper chambers 82 and 92 from the distributor valve 7.

The fluid flow Q in circuit 4 splits into equal portions Q/2 respectively entering chambers 82 and 92 so that only half of it acts upon the piston 84 in chamber 82. Since the areas of the circular lower surface and annular upper surface of each piston are in the ratio 2:1, the displacement rate in chamber 83 is twice that in chamber 82 whereby the flow Q in circuit 4 and the return flow Q' in circuit 5 are equal and the combination is symmetrical.

The leakage which occurs in the distributor valve 7 and the rams 8 and 9 is represented by a leakage circuit which connects circuits 4 and 5 and which contains a constriction $R_f$.

It will be recalled that what is called a constriction is a calibrated pressure loss which is brought about in a hydraulic circuit in order deliberately to limit the flow through this circuit.

The lower chamber 93 is maintained at the reference pressure via a circuit 1. In the case of a fixed imbalance, a pressure $P_e$ to balance out this imbalance is applied to the chamber.

In a prior-art arrangement, a load which is out of balance by a fixed or varied amount is controlled by means of the conventional control system illustrated by the block diagram shown in FIG. 3.

The load 306 is operated by a ram 308 which may be a single-rod, double-acting ram for example. This ram is supplied by a valve 307 whose stem is electrically displaceable by a control system.

This control system, like all the control systems for valves or distributors which we shall discuss hereafter, may be represented symbolically by an amplifier 312 supplying a magnetic coil 300 which acts on the stem of the valve or distributor. A valve or distributor fitted with a control system is called a servo-valve or servo-distributor as the case may be.

The set-point or position instruction 313 is transmitted to the amplifier 312 in this control system via a block 311 which represents the other components in the direct chain, such as corrective networks.

Regulation is performed by a loop containing a sensor 310 for determining the position of the load, whose signal is subtracted from the set-point signal 313 in a comparator 315 to produce an error signal 314.

In such a system, the imbalance, such as the weight of the load for example, is not hydraulically compensated directly at the ram and it is therefore the electro-hydraulic control system which compensates for the imbalance according to the variations in the error signal 314.

In the case of a launching ramp, it is necessary at all times to exert an upward pressure, in addition to that called for by the set-point signal, in order to compensate for the weight of the ramp. Consequently, in the case of a double-acting ram, the pressure differential at the connections of the servo-valve remains high even when the set-point position is constant.

Prior-art systems in which the responsibility for compensating for the imbalance devolves on the electro-hydraulic control system require a relatively high power consumption even when the set-point position remains constant.

SUMMARY OF THE INVENTION

An object of the present invention is to provide a hydraulic compensation for the imbalance of the load on a servo-control system, particularly when this imbalance may vary, in order in this way to minimize the power consumption, in particular by maintaining the pressure differential at the connections of the servo-valve at a level close to zero, on average.

In accordance with a feature of our invention, the servo-control system, which incorporates a double-acting ram, also includes a pneumatic accumulator, hydraulic circuits for connecting this accumulator to the ram, a number of switches and constrictions arranged in those circuits, a logic unit for controlling the switches, and an arrangement for measuring the amount by which the load is out of balance, these elements together belonging to a loop for compensating hydraulically for the imbalance.

What is achieved in this way is the modulation of a balancing pressure which is applied to one of the chambers of the ram and which is slaved to the variations in the imbalance.

BRIEF DESCRIPTION OF THE DRAWING

The invention will be better understood from the following description of an embodiment when read in conjunction with the accompanying drawing in which:

FIG. 1 is a schematic view of a conventional missle-launching ramp;

FIG. 2 is a diagram of a conventional single-rod, double-acting ram;

FIG. 3 is a block diagram of a conventional servo-control system comprising a servo-valve and a ram;

FIG. 4 is a diagram of a particular embodiment of the servo-control system according to the invention;

FIG. 5 is a detail of a modification of the embodiment shown in FIG. 4.

SPECIFIC DESCRIPTION

In the following description it is assumed that the ram is of the type shown in FIG. 2 as described in the above mentioned French Pat. No. 2,063,698 and is used to control the elevation of a launching ramp.

FIG. 4 can be divided into 3 sub-assemblies:

an arrangement for regulating the elevation of a launching ramp, whose structure is similar to that shown in FIG. 3 and which comprises a single-rod double-acting ram whose components are identified by the same reference numerals as in FIG. 2;

a hydraulic system which produces the pressure $P_e$ (FIG. 2) which is applied to the chamber 93 of the ram, the system comprising hydraulic circuits 1, 2 and 3 and an accumulator 25;

an electrical arrangement for regulating the hydraulic system, which is represented in block-diagram form by blocks 16 to 24.

The arrangement for regulating the launching ramp in elevation employs the conventional layout which is described above and shown in FIG. 3. The parenthetical numbers in the following paragraph indicate the corresponding items in FIG. 3.

A signal 13 (313) indicating the set-point position is applied to a comparator 15 (315) to produce an error signal 14 (314). The latter signal is in turn applied to a block 11 (311) which represents components in the direct chain, such as correcting networks. Block 11 is connected to a circuit 12 (312 and 300) for controlling a four-way servo-valve 7 (307) which supplies a single-rod, double-acting ram (308) comprising two conventional rams 8 and 9 whose rods 81 and 91 are secured rigidly together. The coupling between the rods is provided by a mechanical elevating structure 106 which forms part of the load (306) on the system. A position sensor 10 (310) connected to this mechanical structure produces a signal representative of the position in elevation and this signal is transmitted to the comparator 15 (315) to be subtracted from the set-point-position signal 13 (313). The association between the sensor 10 and the ramp 106 is shown by a broken line since it is, for example, mechanical.

The assembly formed by the servo-valve 7 and the rams 8 and 9 has been described above and its parts are identified in FIG. 4 by the same references as in FIG. 2, with the single exception of the common cross-piece 6 in FIG. 2 which is replaced in FIG. 4 by the mechanical elevating structure 106 for the launching ramp (cf. FIG. 1).

The hydraulic system which generates the balancing pressure $P_e$ applied to the lower chamber 93 comprises the aforedescribed oleopneumatic accumulator 25 and three hydraulic circuits 1, 2 and 3. It is the pressure in the accumulator 25 which governs the pressure $P_e$.

Circuits 2 and 3 are responsible respectively for pressurizing and depressurizing the accumulator 25. Circuit 2 connects it to the working pressure $P_s$ via a first constriction $R_2$ and a first servo-distributor $D_2$. Circuit 3 connects it to the reference pressure $P_o$ via a second constriction $R_3$ and a second servo-destributor $D_3$.

The servo-distributors $D_2$ and $D_3$ operate as switches. They allow fluid to pass when they are open and prevent it from doing so when they are closed.

The constrictions $R_2$ and $R_3$, which produce calibrated pressure losses, determine the rates at which the accumulator 25 is pressurized and depressurized. The amount of loss they cause depends chiefly on the manner of change of the imbalance, that is to say, in the specific case in question, on the sequence in which the missiles are fired. It is the correct choice of the constrictions which optimizes the performance.

The accumulator 25 is connected to the lower chamber 93 via the hydraulic circuit 1 in which is situated a third constriction $R_1$ for damping out distortion phenomena in the mechanical structure. By these distortion phenomena we mean the mechanical vibrations which occur in the load. In the particular case of a missile-launching ramp, these would be, for example, the vibrations caused by the firing of a missile.

In certain cases, the third constriction $R_1$ cuts down the response rate of the system to an excessive degree, in particular when the launching ramp is being adjusted to follow a target. To remedy this shortcoming, there is a by-pass circuit containing a third servo-distributor $D_1$ which provides a way around the contriction $R_1$. The servo-distributor $D_1$ operates also as a switch. It is closed in normal operation and the fluid then passes through the branch containing $R_1$. It is open when a reset occurs and the fluid then flows through the branch containing $D_1$.

The electrical arrangement for regulating the hydraulic system B acts on the latter by means of control blocks 21, 22 and 23 and the three servo-distributors $D_1$, $D_2$ and $D_3$.

Servo-distributor $D_1$ is operated by a manual control 24 which may be a two-position switch. This switch controls the supply to a block 21 controlling the distributor $D_1$.

The electrical system for controlling the pressurization of the accumulator 25 comprises circuit blocks 16 to 20 and control blocks 22 and 23.

The hydraulic circuits 40 and 50, which are associated with ram-supply circuits 4 and 5 respectively, terminate at a pressure-differential sensor 16. This sensor 16, which may for example be of the strain-gauge type, thus emits a signal representing the difference in pressure between circuits 4 and 5, and thus between the pressure in the upper chambers (82, 92) and that in the lower chamber 83. In first approximation, this difference represents the discrepancy between the imbalance and the balancing pressure $P_e$.

In effect, because the launching ramp is adjusted in elevation, its error signal is generally small and the difference in pressure which is caused between circuits 4 and 5 by servo-valve 7 is generally small in comparison with that resulting from the variation in the imbalance.

Nevertheless, in the transitional phases when the elevation set-point position 13 is being altered, it is necessary that the difference in pressure which is caused by this alteration in the set-point position is not considered as a discrepancy between the imbalance and the balancing pressure. For this purpose, block 16 is connected to an inhibiting block 17 which in turn receives the error signal 14 at a different point. The inhibitor block comprises a threshold circuit and a switch. Depending upon whether the absolute value of the error signal 14 is above or below the threshold of block 17, it does or does not operate the switch and the output signal from block 17 is zero or the signal emitted by block 16. The inhibitor block 17 is connected to a block 18.

Block 18 is a low-pass filter which filters out any fast fluctuations that may occur in the pressure differential, resulting for example from vibrations caused by the firing of a missile. Filter 18 is connected to a block 19.

Block 19 is a threshold circuit which enables the cancellation of minor variations in a signal emitted by filter 18, given that they are not necessarily representative of a discrepancy between the imbalance and the pressure $P_e$. Threshold circuit 19 is connected to a logic control unit 20.

Logic control unit 20 looks at input signals of three types: positive signals, negative signals and zero signals. It has two outputs connected to control blocks 22 and 23 which belong to servo-distributors $D_2$ and $D_3$ respectively.

If the input signal to logic unit 20 is positive, that is to say if the pressure in circuit 4 is higher than that in circuit 5, logic unit 20 opens servo-distributor $D_3$ and holds $D_2$ closed in order to reduce the balancing pressure $P_e$.

Conversely, if the input signal is negative, logic unit 20 opens $D_2$ and closes $D_3$ in order to increase.

Finally, if the input signal is zero, which means either that one of the blocks 17, 18 and 19 has inhibited the signal emitted by sensor 16, or that the imbalance is exactly compensated, the logic unit 20 holds both servo-distributors closed.

Thus, a loop for compensating hydraulically for the imbalance is produced, which enables the system to retain its dynamic performance characteristics when operating at high speed, for example in the phase where it is being brought to bear on a target, and which optimizes performance in slow-speed operation, for example when tracking a target.

In a modification of the embodiment described above, the signal generated by the sensor 16 for detecting a pressure differential is replaced by the negative-feedback-current signal from the block 12 for controlling the servo-valve 7. This version is more economical as regards the components used (the sensor 16 dispensed with) but does not provide such a high performance.

FIG. 5 is a schematic view of the modification which this version entails.

The block 12 can be divided into an amplifier 120, a coil 121 and two resistors R and r, resistor r being situated in the negative-feedback circuit and resistor R being grounded. Resistor R is very small in comparison with resistor r. The current I traversing resistor R is therefore very large in comparison with the current i passing through resistor r and can thus be considered as similar to the current (I plus i) in the coil 121. The voltage RI at the junction M of resistors R and r with coil 121 is thus representative of movement of the rod of valve 7. This voltage is taken to reflect the pressure differential between circuits 4 and 5.

Thus, in this version, the inhibitor block 17 is connected by its inputs to points M and to the error signal 14. The sensor 16 is dispensed with to the detriment of accuracy and at the expense of drift in the servo-control of the balancing pressure $P_e$, due to the inherent shortcomings of the servo-valve, namely its threshold, its hysteresis and its drift.

The foregoing description of a hydraulic servo-control system is considered a preferred case where the elevation of a missile-launching ramp is being servo-controlled. However, the servo-control system according to the invention, which is characterized by its loop for hydraulically compensating for the imbalance, can be employed whatever the reasons for or the direction of the imbalance, inasmuch as the ram of the servo-control system is double-acting and a chamber is available to which the balancing pressure can be applied separately from the control pressure.

The servo-control system according to our invention is particularly well suited to cases where the imbalance in the load varies by large amounts, as is the case with a missile-launching ramp.

What we claim is:

1. In a electro-hydraulic servo-control system whose load is unbalanced by a varying amount comprising at least two half double acting single-rod rams, and a pneumatic accumulator for compensating for the unbalance, the improvements comprising control servo-valve sensing means for measuring the pressure resulting from said unbalance, controlling and damping electrical and hydraulic circuit means, all said means being arranged so as to form a main loop for controlling the position of the load and an auxiliary loop for so regulating the pressure in said pneumatic accumulator that the unbalance is compensated for in said main loop.

2. An electro-hydraulic servo-control system according to calim 1, wherein said accumulator for compensating for the unbalance is subject to a working pressure and to a reference pressure, said working pressure acting via a first hydraulic circuit including a first constriction and a first switch, and said reference pressure acting via a second hydraulic circuit including a second constriction and a second switch, said first and second constrictions producing calibrated pressure losses whose values are a function of the pattern of variation in said imbalance.

3. An electro-hydraulic servo-control system according to claim 2, wherein said first and second switches are formed by servo-distributors having respective control blocks which are controlled by a logic control unit.

4. An electro-hydraulic servo-control system according to claim 1, wherein said accumulator for compensating for the imbalance is connected to one chamber of one of said half double-acting rams by a third hydraulic circuit including a third constriction for a fine setting of the load position and damping out the distortion phenomena in the load.

5. An electro-hydraulic servo-control system according to claim 4, wherein there is provided a circuit for bypassing said third constriction, comprising a third switch, said circuit allowing fluid to flow while said servo-control system is operating at high speed.

6. An electro-hydraulic servo-control system according to claim 5, wherein said third switch is formed by a servo-distributor having a control block operated by a manual control.

7. An electro-hydraulic servo-control system according to claim 1, wherein said sensing means for measuring the amount of imbalance comprises a differential pressure sensor connected to the output of said servo-valve.

8. An electro-hydraulic servo-control system according to claim 7, wherein said sensing means comprises further electronic means for measuring the residual error of said main loop.

9. An electro-hydraulic servo-control system according to claim 8, wherein said means for measuring the amount of imbalance is connected to the input of a low-pass filter having an output connected to the input of a threshold circuit which cancels out minor variations in the signal delivered by said low pass-filter, the output of said threshold circuit being connected to the input of the logic-control unit.

10. An electro-hydraulic servo-control system according to claim 3, wherein said logic control unit acts on said servo-distributors in such a way as to increase the pressure in the accumulator when the input signal applied to it is negative, in such a way as to reduce the pressure in the accumulator when the input signal is positive, and in such a way as to leave the pressure therein constant when its input signal is zero.

11. An electro-hydraulic servo-control system according to claim 9, wherein said electronic means for measuring the residual error of the main loop is an inhibitor block inserted between said means for measuring the amount of imbalance and the said low-pass filter, said block also being connected to an error signal in the servo-control system and inhibiting the signal emitted by said differential pressure sensor if said error signal exceeds a limiting value.

* * * * *